United States Patent [19]

McMonigle et al.

[11] 4,414,089

[45] Nov. 8, 1983

[54] ELECTROLYSIS CELL FOR REDUCTION OF MOLTEN METAL HALIDE

[75] Inventors: Matthew J. McMonigle, New Kensington; Alfred F. LaCamera, Level Green, both of Pa.

[73] Assignee: Aluminum Company of America, Pittsburgh, Pa.

[21] Appl. No.: 404,347

[22] Filed: Jul. 30, 1982

[51] Int. Cl.[3] ..... C25C 3/08

[52] U.S. Cl. ..... 204/244; 204/243 R; 204/245

[58] Field of Search ..... 204/243 R, 244, 245, 204/64 R, 66, 67

[56] References Cited

U.S. PATENT DOCUMENTS

| | | | |
|---|---|---|---|
| 1,545,383 | 7/1925 | Ashcroft | 204/244 |
| 2,959,533 | 11/1960 | DeVarda | 204/244 |
| 3,554,893 | 1/1971 | De Varda | 204/244 |
| 3,822,195 | 7/1974 | Dell et al. | 204/64 R |
| 3,893,899 | 7/1975 | Dell et al. | 204/244 |
| 4,110,178 | 8/1978 | LaCamera et al. | 204/64 R |
| 4,140,594 | 2/1979 | Rogers, Jr. et al. | 204/67 |
| 4,151,061 | 4/1979 | Ishikawa et al. | 204/247 |

OTHER PUBLICATIONS

Bureau of Mines Report of Investigation 8166, "Recovery of Lead From Lead Chloride by Fused-Salt Electrolysis", 1976.

*Primary Examiner*—R. L. Andrews
*Assistant Examiner*—Terryenie Chapman
*Attorney, Agent, or Firm*—Andrew Alexander

[57] ABSTRACT

Metal is produced in a cell containing a plurality of electrodes which are horizontally disposed and arranged in at least one vertical stack. Each stack includes a cathode, at least one intermediate bipolar electrode and an anode. The electrodes in each stack are arranged in a superimposed, spaced relationship defining interelectrode spaces between each pair of adjacent electrodes. The upper face of each cathode and of each of the bipolar electrodes has at least one reservoir, bounded by a perimetric wall, for collecting metal produced in the cell. Each perimetric wall has level maintaining means associated therewith so that a pool of the metal in the reservoir will be maintained at a predetermined level beneath the top of the perimetric wall. Metal produced during operation of the cell in excess of that required to fill the reservoir to the predetermined level will drain from the reservoir via the level maintaining means.

11 Claims, 4 Drawing Figures

ELECTROLYSIS CELL FOR REDUCTION OF MOLTEN METAL HALIDE

BACKGROUND OF THE INVENTION

The present invention relates to bipolar electrolysis cells for the production of metal by the reduction of a metal halide in a molten bath comprising the metal halide dissolved in at least one molten halide of higher electrodecomposition potential than the metal halide. More particularly, this invention relates to such cells having a plurality of electrodes, disposed horizontally and arranged in at least one vertical stack in a superimposed, spaced relationship defining inter-electrode spaces, where metal is produced, between each pair of adjacent electrodes. The present invention relates to an improvement in such cells for collecting the metal produced while maintaining substantially constant anode-cathode spacing in the inter-electrode spaces.

Bipolar electrolysis cells for the production of metal by the reduction of a metal halide in a molten halide batch have been known for many years. A cell of this type, which is reportedly useful in connection with a process for the production of either zinc or lead by the reduction of the appropriate metal chloride, is described in U.S. Pat. No. 1,545,383 of Ashcroft. The Ashcroft cell includes a series of inclined graphite plates which function as bipolar electrodes. These electrodes are arranged in a superimposed, spaced relationship defining inter-electrode spaces between each pair of adjacent electrodes. The electrodes are enclosed within a metallic shell having an insulated refractory lining. The cell is adapted to contain a molten bath of metallic chlorides, in which the electrodes are immersed. As electrolysis proceeds in this cell, metal and chlorine are produced in the inter-electrode spaces. Because of the inclination of the electrodes, the metal produced in the cell flows, under the influence of gravity, downwardly across the cathode surfaces of the electrodes and through holes in the electrodes to a metal-collecting zone in the bottom of the cell. At the same time, the chlorine produced in the cell flows, because of its buoyancy, upwardly across the inclined anode surfaces of the electrodes and through holes therein to a gas-collecting zone in the top of the cell. The anode and cathode surfaces of the electrodes to this cell may be corrugated to facilitate the flows of metal and chlorine in the cell. These flows reportedly induce circulation of the bath in the cell and thereby facilitate continuous electrolysis. However, it has been observed that in a cell of this type, the flow of metal across the cathode surfaces may reduce the anode-cathode spacing in an uncontrolled and unpredictable fashion, and thereby reduce cell efficiency.

A bipolar electrolysis cell for the production of lead by the reduction of lead chloride in a molten halide bath is described in Bureau of Mines Report of Investigations No. 8166, entitled "Recovery of Lead From Lead Chloride by Fused-Salt Electrolysis". This cell includes a plurality of graphite plates which function as bipolar electrodes. These electrodes are arranged in a vertical stack in a superimposed, spaced relationship defining inter-electrode spaces between each pair of adjacent electrodes. The electrodes are inclined slightly from the horizontal and grooved on the anode and cathode surfaces to direct the flow of lead and chlorine produced during electrolysis to opposite sides of the cell. Gaps on both sides of the stack of electrodes allow lead to flow downwardly and chlorine to flow upwardly on opposite sides of the stack. Thus, the cell described in the Bureau of Mines Report is similar in many respects to the Ashcroft cell. In both cases, metal flows downwardly across the cathode surfaces of the electrodes, under the influence of gravity, to one side of the stack and then to the bottom of the cell, while chlorine flows upwardly across the anode surfaces of the electrodes, because of its buoyancy, to the opposite side of the stack and then to the top of the cell.

A bipolar electrolysis cell which operates in a different manner is described in U.S. Pat. No. 3,893,899 of Dell et al. This cell is particularly adapted for the production of aluminum by the electrolytic reduction of aluminum chloride in a molten halide bath. It includes an anode, at least one intermediate bipolar electrode and a cathode in a superimposed, spaced relationship defining inter-electrode spaces therebetween. These electrodes, unlike the electrodes in the Ashcroft cell, are preferably disposed horizontally within a vertical stack. Along one side of the stack of electrodes is located a bath-supply passage, which is in fluid communication with each inter-electrode space within the stack. Along the opposite side of the stack is a gas-lift passage, which is also in fluid communication with each inter-electrode space. As electrolysis proceeds in this cell, chlorine is produced on the anode surfaces of the electrodes, and metal is produced on the cathode surfaces. The chlorine is conducted through the inter-electrode spaces toward and into the gas-lift passage. This flow of chlorine induces a flow of molten bath into and out of each inter-electrode space, upwardly in the gas-lift passage, across the stack of electrodes and downwardly through the bath-supply passage. The flow of bath entrains metal produced on each cathode surface and carries it through and out of each inter-electrode space. This effectively prevents metal from accumulating on the cathode surfaces and permits desirably low anode-cathode spacing. The metal, which is entrained by the flow of bath, is carried into the gas-lift passage, where it descends under the influence of gravity, in a direction opposite to that of the rising chlorine and bath, to the bottom of the cell. However, it has been observed that in a cell of this type, under certain circumstances, metal which is carried into the gas-lift passage may there combine with the chlorine therein, or it may be carried to the top of the cell, along with the chlorine and bath, where it may combine with the chlorine to produce the metal chloride. The occurrence of these events may adversely affect the efficiency of the cell, since a portion of the metal reduced combines with chlorine to produce the metal chloride.

Bipolar electrolysis cells have also been used to produce aluminum or another metal by the reduction of the metal oxide in a molten halide bath. Because of the nature of the bath used in such cells, electrolytically active, carbonaceous cathode surfaces in these cells are often protected from attack by bath constituents by a layer of molten metal. Such cells are usually operated so that metal produced therein accumulates in a protective layer on the cathode surfaces of the electrodes in the cell. Such a method of operation, while advantageously protecting the cathode surfaces, may reduce cell efficiency by continuously building up a layer of metal on the cathode surfaces, thereby continuously varying the anode-cathode spacing.

A bipolar electrolysis cell which is used to produce aluminum by the reduction of aluminum oxide in a molten halide bath is described in U.S. Pat. No. 2,959,533 of de Varda. FIG. 2 of this patent shows a cell having a plurality of inclined bipolar electrodes which are spaced so as to form inter-electrode spaces between each pair of adjacent electrodes. The cathode surface of each electrode includes a number of cavities which are adapted to retain a portion of the molten aluminum produced in the cell. When filled with molten aluminum, these cavities form electrolytically active, protected areas on the cathode surfaces. Aluminum produced in the inter-electrode spaces in excess of that required to fill these cavities flows down the inclined cathode surfaces into a metal-collecting zone in the bottom of the cell. However, such a flow of metal across the cathode surfaces of a cell of this type may change the anode-cathode spacing in an uncontrolled and unpredictable manner, and thereby reduce cell power efficiency.

Another bipolar electrolysis cell of the type which is adapted to retain molten metal in a protective layer on its cathode surfaces is described in U.S. Pat. No. 3,554,893 of de Varda. This cell includes a plurality of bipolar electrodes which are disposed horizontally in a vertical stack with inter-electrode spaces between each pair of adjacent electrodes. Each of these electrodes is in the form of a flat tray with upwardly curved borders. The concave upper cathode face of each electrode fills with metal during electrolysis. Metal produced thereafter overflows from the cathode surface and drops onto the surface of the electrode below or onto the bottom of the cell. However, in this type of construction, the metal may overflow the cathode surface at a variety of different and possibly nonrepeating places. In a cell designed for directional flow of evolved gas and circulating bath constituents, as well as reduced metal, such directed flow of metal could cause problems such as inducing recombination of reduced metal with halogen gas should the spillover of metal be directly in the path of gas flow.

SUMMARY OF THE INVENTION

It is an object of the present invention to provide a bipolar electrolysis cell which is suitable for producing metal by the reduction of a metal halide in a molten halide bath. It is another object of this invention to provide such a cell which may be operated in such a way that metal produced therein will not adversely alter the anode-cathode spacing between adjacent electrodes. It is yet another object of this invention to provide a cell in which the accumulation and removal of metal produced are controlled. In accordance with these and other objects, an improved cell is provided in which a plurality of electrodes are horizontally disposed and arranged in at least one vertical stack. Each stack includes a cathode, at least one intermediate bipolar electrode and an anode. The electrodes in a stack are arranged in a superimposed, spaced relationship defining inter-electrode spaces between each pair of adjacent electrodes. The upper face of each cathode and of each of the bipolar electrodes has at least one reservoir, bounded by a perimetric wall, for collecting metal produced in the cell. Level maintaining means cooperate with the perimetric wall to provide a pool of metal in the reservoir maintained at a predetermined level beneath the top of the perimetric wall. Metal produced during operation of the cell in excess of that required to fill the reservoir to the predetermined level will drain via the level maintaining means.

In order to facilitate an understanding of the invention, its features are illustrated in the accompanying drawings and a detailed description thereof follows. It should be understood nevertheless that it is not intended that the invention be limited to the particular embodiment shown. Various changes and alterations are contemplated such as would ordinarily occur to one skilled in the art to which the invention relates.

DETAILED DESCRIPTION OF THE INVENTION

Figure 1:
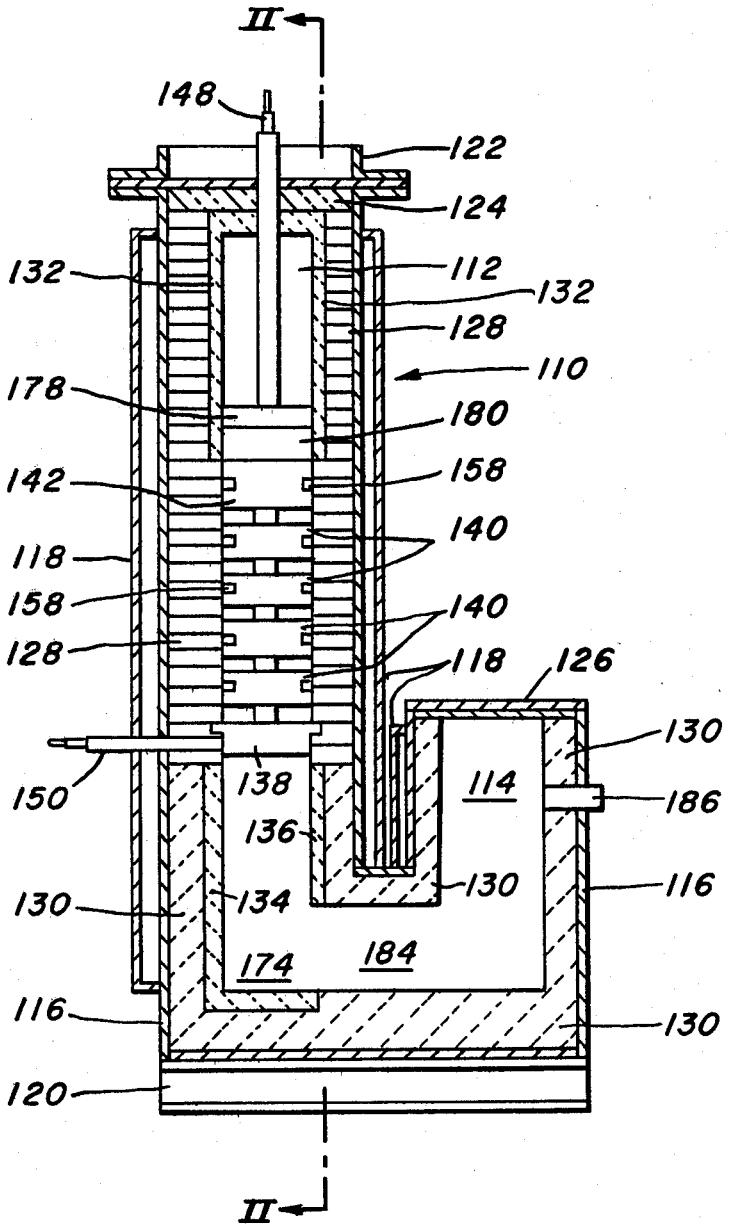
FIG. 1 is a sectional elevation of an electrolytic cell constructed in accordance with the principles of this invention.

A preferred embodiment of this invention, which is illustrated by the drawings, may be employed to produce metal by electrolytic reduction of a metal halide in a molten bath comprising the metal halide dissolved in at least one molten halide of higher electrodecomposition potential than the metal halide. However, this cell is particularly appropriate for employment in the production of lead from the electrolytic reduction of lead chloride in a molten bath containing a mixture of lead chloride, potassium chloride and lithium chloride. As a matter of fact, a cell of the design illustrated by the drawings has been constructed and used to produce lead by such method. Consequently, the discussion that follows describes this improved cell in terms that relate to the production of lead by the method which has been used.

Cell 110 includes electrolysis section 112, where lead is produced, and forewell chamber 114, where the metal produced is collected. Both section 112 and chamber 114 are contained within outer shell 116, which is preferably of steel. Structural support for the outer shell is provided by reinforcing members 118 and I-beams 120, also preferably of steel. Electrolysis section 112 is enclosed by electrolysis lid assembly 122, which includes layer 124 of thermal insulation. The forewell chamber is enclosed by forewell lid assembly 126.

The upper portion of the electrolysis section of the cell is lined with an inner refractory brick lining 128. The lower portion of electrolysis section 112 and forewell chamber 114 are lined with an inner refractory lining 130 which preferably has a low thermal conductivity and is resistant to attack by molten metal. Located adjacent to and inside of linings 128 and 130 are carbonaceous lining elements 132, 134 and 136. These carbonaceous elements are especially resistant to attack by molten metal or chlorine gas. Carbonaceous elements 132, 134 and 136, preferably of graphite, are fitted into machined recesses in brick lining 128 and refractory lining 130.

Within electrolysis section 112 are a plurality of electrodes which are disposed horizontally and, in the embodiment illustrated, are arranged in two vertical stacks. Each stack includes a cathode 138, at least one intermediate bipolar electrode 140 (in the embodiment shown, there are four) and an anode 142. The cathode has an upper lip which is fitted into machined recesses in brick lining 128. The remaining electrodes are stacked each above the ones below, with their sides abutting brick lining 128, in a spaced relationship established by interposed refractory spacers 144. These spacers are sized to closely space the electrodes so as to define inter-electrode spaces between each pair of adjacent electrodes. Preferably, the electrodes are spaced with their adjacent surfaces separated by $\frac{3}{4}$ inch or less. In the illustrated embodiment, five inter-electrode spaces are provided between adjacent electrodes in each stack, one between the cathode and the lowest of the bipolar electrodes, three between successive pairs of intermediate bipolar electrodes and one between the highest of the bipolar electrodes and the anode. Each inter-electrode space is bounded on the top by a lower face of one electrode (which face functions as an anode) and on the bottom by an upper face of another electrode (which face functions as a cathode).

The anode 142 of each stack is connected to at least one anode terminal 148 (in the embodiment shown, there are three) which serves as a positive current lead. Similarly, each cathode 138 is connected to at least one cathode terminal 150 which serves as a negative current lead.

The anode terminals extend through and are suitably insulated from the electrically conductive portions of electrolysis lid assembly 122. Similarly, the cathode terminals extend through and are suitably insulated from the electrically conductive portions of brick lining 128, outer shell 116 and coolant liquid containment member 118. When an appropriate voltage is imposed between the anode and the cathode in a stack, or bipolar character is imparted to the intermediate electrodes 140.

Cell 110 may be operated at a suitable temperature to produce metal by electrolytic reduction of a halide of the metal in a molten bath comprising the metal halide dissolved in at least one molten halide of higher electrodecomposition potential than the metal halide. When this cell is operated to produce lead, therefore, the preferred operating temperature is within the range of 400–500° C. and the preferred bath composition is comprised of lead chloride dissolved in at least one molten halide of higher electrodecomposition potential than lead chloride. These halides are preferably alkali metal chlorides, although other alkali metal halides and alkaline earth halides may be used. Good results are obtained when the bath composition comprises a mixture of lead chloride, potassium chloride and lithium chloride. In a bath of this composition, it is desirable that the weight ratio of potassium chloride to lithium chloride be within the range of 1:1.4 to 2:1. A presently preferred bath composition comprises a mixture of 20–70% by weight lead chloride, 15–55% by weight potassium chloride and 10–40% by weight lithium chloride. An especially preferred composition contains about 40% by weight lead chloride, 35% by weight potassium chloride and 25% by weight lithium chloride.

Figure 3:
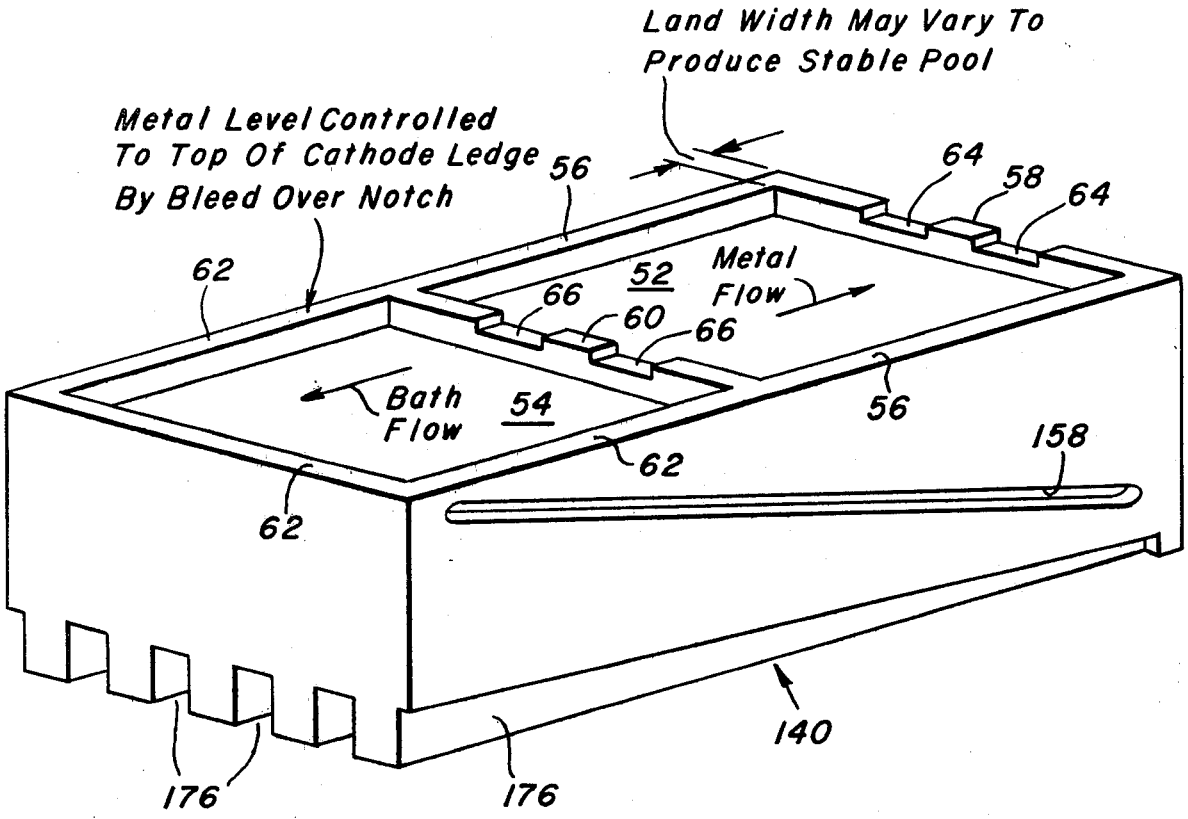
FIG. 3 is a plan view of one of the bipolar electrodes of the cell of FIGS. 1 and 2.

When cell 110 is operated in the preferred manner to produce lead, electrolysis takes place in each inter-electrode space in a stack to produce chlorine on the lower (anode) face of the electrode at the top of the inter-electrode space and lead on the upper (cathode) face of the electrode at the bottom of the inter-electrode space. In accordance with the present invention, the upper face of each cathode and of each of the bipolar electrodes is provided with at least one reservoir, bounded by a perimetric wall, for collecting metal produced in the adjacent inter-electrode space. In FIG. 3, a preferred embodiment of the bipolar electrode 140 of cell 110 is illustrated in detail (the upper face of cathode 138, although not illustrated, is substantially similar to the upper face of bipolar electrode 140, as shown in FIG. 3). The upper face of electrode 140 includes two reservoirs, left reservoir 54 and right reservoir 52. Each of these reservoirs is bounded by a perimetric wall. Reservoir 52 is bounded on two sides by wall portion 56, on one side by wall portion 58 and on another side by wall portion 60. Reservoir 54 is bounded on three sides by wall portion 62 and on one side by wall portion 60.

In accordance with the invention, level maintaining means are provided in cooperation with the perimetric walls to maintain the metal pool in reservoirs 52 and 54 at a predetermined level. In the preferred embodiment, the level maintaining means comprise one or more notches cut into the perimetric walls to a predetermined depth. The notches are positioned to direct the flow of metal toward specific passages between the electrodes through which the metal may flow to a reservoir or well at the bottom of the cell. Each of the perimetric walls bounding a reservoir has at least one notch cut therein. Thus, in the embodiment of FIG. 3, two notches 64 are cut in wall portion 58 and two notches 66 are cut in wall portion 60. The notches in a perimetric wall are cut to such a depth that a pool of the metal in the reservoir will be maintained, because of the surface tension of the metal, at a level adjacent the top of the perimetric wall (it has been found that, in a cell such as cell 110 which is used to produce lead, the notches in each electrode 140 should be cut to a depth of about $\frac{1}{8}$ inch). Metal produced in the adjacent inter-electrode space in excess of that required to fill the reservoir to the level at the top of the perimetric wall will drain from the reservoir through the notches. Thus, after metal production in an inter-electrode space has filled the adjacent reservoirs, the anode-cathode spacing will not be altered by production of additional metal. There will be no buildup of metal on the lower (cathode) faces of the electrodes and no substantial flow of metal across such faces.

Figure 2:
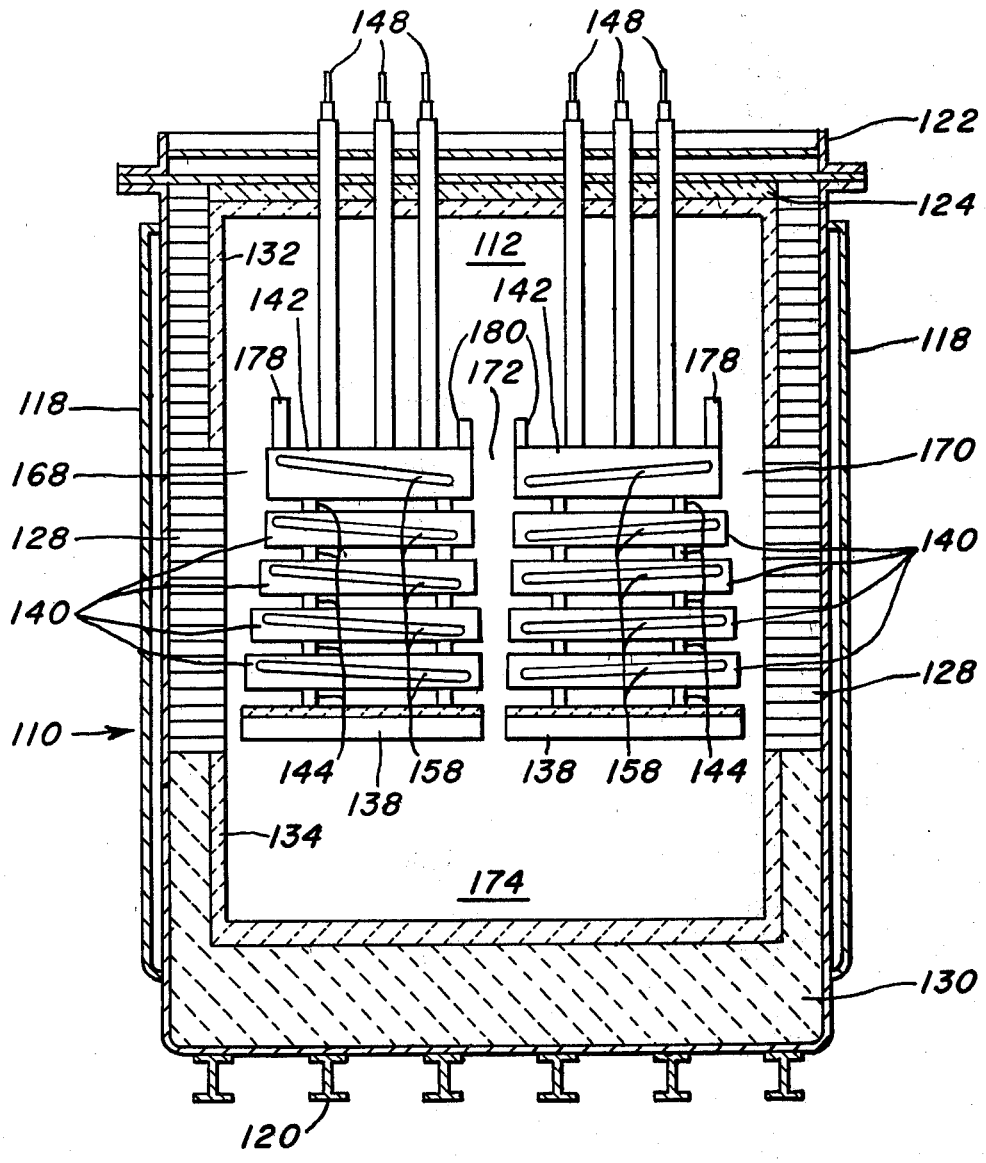
FIG. 2 is a sectional view of the cell of FIG. 1, taken along the line II—II.

In a preferred embodiment of this invention, the cell includes a vertical gas-lift passage associated with each stack of electrodes. The gas-lift passage is in fluid communication with each inter-electrode space in the stack. As shown in FIG. 2, cell 110 includes two gas-lift passages. Gas-lift passage 168 is associated with the left stack of electrodes, and gas-lift passage 170 is associated with the right stack of electrodes.

The preferred embodiment of the cell also includes a vertical bath-supply passage associated with each stack of electrodes. The bath-supply passage is also in fluid communication with each inter-electrode space in the stack and is preferably located at the opposite side of the stack from the gas-lift passage. Adjacent stacks of electrodes may share the same bath-supply passage. Thus, as shown in FIG. 2, both stacks of electrodes are associated with common bath-supply passage 172.

Below each stack of electrodes and in fluid communication with the bath-supply passage associated therewith is a metal-receiving chamber such as chamber 174 of cell 110. In the preferred embodiment of the cell, the reservoirs and the notches in the perimetric walls of the reservoirs of each electrode in a stack are located so that metal produced during operation of the cell in excess of that required to fill the reservoirs to a level at the top of the perimetric wall will drain from the reservoirs through the notches into and downwardly through the bath-supply passage of the stack into the metal-receiving chamber. Thus, as shown in FIG. 3, notches 66 and 64 are located so that metal may drain therethrough from reservoirs 54 and 52 respectively in a direction from left to right. Excess metal accumulating in left reservoir 54 will drain through notches 66 located in wall portion 60 to right reservoir 52. Excess metal accumulating in right reservoir 52 will drain through notches 64 located in wall portion 58 in a direction toward the right of electrode 140. Thus, electrode 140, oriented in cell 110 as shown in FIG. 3 (so that metal drains from its reservoirs in a direction from the left to the right), would be included in the left stack of electrodes of cell 110. Oppositely oriented electrodes would be included in the left stack of electrodes of cell 110. Consequently, metal from the reservoirs of the electrodes in the right stack drains through notches located on the left side of the electrodes into and downwardly through bath-supply passage 172 into metal-receiving chamber 174. At the same time, metal produced in the inter-electrode spaces of the left stack of electrodes drains through notches located on the right side of the electrodes into and downwardly through passage 172 into chamber 174.

The preferred embodiment of the cell also includes at least one inclined gas-channel located in the lower face of each anode and in the lower face of each bipolar electrode for conducting chlorine gas produced during operation of the cell from the inter-electrode spaces of a stack to the gas-lift passage associated with that stack. In FIG. 3, gas-channels 176 are shown in a bipolar electrode 140 of cell 110, (the lower face of anode 142, although not illustrated, is substantially similar to the lower face of bipolar electrode 140). Since gas-channels 176 in electrode 140 are provided with increasing depth from right to left in FIG. 3, these channels conduct chlorine produced in the adjacent inter-electrode space toward the left side of electrode 140 in FIG. 3. Thus, electrode 140, oriented as shown in FIG. 3, would be included in the left stack of electrodes of cell 110, as shown in FIG. 2. Consequently, its gas-channels 176 conduct chlorine to gas-lift passage 168, where because of its buoyancy, it is conducted upwardly through passage 168. At the same time, chlorine produced in the inter-electrode spaces of the right stack of electrodes is conducted into and upwardly through gas-lift passage 170.

The flow of gas out of the inter-electrode spaces of a stack of electrodes into and upwardly through the gas-lift passage induces a flow of bath out of the inter-electrode spaces, into and upwardly through the gas-lift passage associated with the stack, across the top of the stack, into and downwardly through the bath-supply passage of the stack and into the inter-electrode spaces. Thus, in cell 110, flows of bath are induced out of the inter-electrode spaces of the left and right stacks, into and upwardly through passages 168 and 170 respectively, across the top of the stacks, into and downwardly through bath-supply passage 172 and into the inter-electrode spaces. In the preferred embodiment of the cell, flow control baffles similar to those described in U.S. Pat. No. 4,110,178 may be used to assist in directing the flow of the bath from the gas-lift passage of a stack of electrodes across the top of the stack but beneath the upper level of the bath. As shown in FIG. 2, two baffles may be associated with each stack of electrodes. Thus, cell 110 includes baffles 178 located adjacent to the gas-lift passage of each stack and shorter baffles 180 located adjacent to the bath-supply passage of each stack. These baffles are adapted to direct the flow of bath as has been mentioned and to increase the velocity of the flow of bath in the inter-electrode spaces.

As illustrated in FIGS. 1, 2 and 3, the preferred embodiment of the cell includes inclined slots 158 in the faces of the bipolar electrodes and the anodes that abut brick lining 128 into which are inserted carbon felt gaskets. These gaskets, which are more particularly described in my co-pending application filed concurrently and entitled "Gasket For Sealing Joints Between Electrodes and Adjacent Cell Lining and for Improving Bath Circulation in Electrolysis Cells", seal the joints of abutment between the electrodes and the adjacent brick lining to minimize the effects of physical shifting of the electrodes during operation of the cell. The provision of these gaskets between the electrodes and the adjacent brick lining also reduces the dimensional accuracy required in the production of the electrodes. In addition, the inclination with respect to the horizontal of the gaskets in slots 158, as shown in FIG. 2, assists in conducting any chlorine that may accumulate in gaps between the bipolar electrodes in a stack and brick lining 128, or between the anode in a stack and lining 128, to the gas-lift passage associated with the stack.

As illustrated in FIG. 1, the preferred cell also includes a metal-collecting zone below each stack of electrodes. This zone is comprised of metal-receiving chamber 174, forewall chamber 114 and interconnecting lateral passage 184. The lateral passage provides fluid communication between and at the bottom of chambers 174 and 114, so that metal collected in the bottom of chamber 174 may flow into chamber 114. The metal-collecting zone is adapted so that metal which flows into the forewell chamber will fill said chamber to a height sufficient to prevent the entry of bath from electrolysis section 112 into the forewell chamber. A tapping port such as port 186 may be provided in the wall of the forewell chamber above the level of the lateral passage so that metal, uncontaminated with bath constituents, may be removed from the cell.

Figure 4:
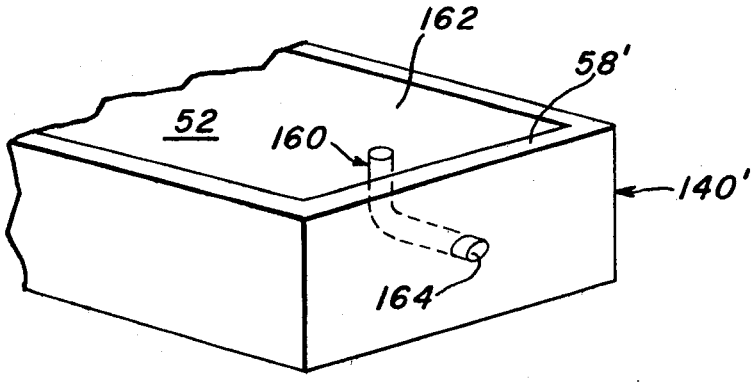
FIG. 4 is a fragmentary sectional view of one of the bipolar electrodes illustrating an alternate embodiment of the invention.

Turning now to FIG. 4, another embodiment of the invention is illustrated. In this embodiment, level maintaining means in electrode 140' comprise one or more tubes of ducts 160 positioned within reservoir 52 and having an open top end 162 within reservoir 52 adjacent the top of perimetric wall 58' and an opposite end 164 protruding through the side of elecrode 140'. In the illustrated embodiment, tube 160 is shown with a right angle bend therein. However, tube 160 may comprise a straight tube mount at an angle in reservoir 52 with top end 162 cut at a bias so as to be parallel with the face of the electrode. In either case, lower end 164 of tube 160 is positioned to direct the flow of metal into the bath-supply passage, as previously described above, rather than toward the gas-lift passage.

Thus, the invention provides a protective pool of metal on the cathode surface of the electrode which is of a predetermined level which provides constant cathode-anode spacing. Furthermore, the protective pool is maintained while directing the flow of excess metal away from the gas-flow to mitigate undesirable recombination of metal with the gas.

It should be understood that this description of the preferred embodiment of the invention is susceptible to various modifications, changes and adaptations, and that the same are intended to be encompassed within the meaning and range of equivalents of the appended claims.

What is claimed is:

1. A cell for producing metal by electrolytic reduction of a metal halide in a molten salt bath comprising the metal halide dissolved in at least one molten salt of higher electrode-composition potential than the metal halide, said cell comprising:

(a) a plurality of electrodes, disposed horizontally and arranged in at least one vertical stack;

(b) each stack including a cathode, at least one intermediate bipolar electrode and an anode;

(c) the electrodes in each stack being adapted to be located beneath the upper level of the bath and arranged in a superimposed, spaced relationship defining inter-electrode spaces between each pair of adjacent electrodes;

(d) the upper face of each cathode and of each of the bipolar electrodes having at least one reservoir, bounded by a perimetric wall, for collecting metal producing during operation of the cell; and (e) level maintaining means within said reservoir to maintain a pool of metal at a predetermined level adjacent the top of said perimetric wall whereby the cathode face of each electrode is protected by a layer of metal and the flow of excess metal from said reservoir is directable toward predetermined paths of metal flow within said cell and away from gas flow paths, said level maintaining means comprising one or more notches cut into the perimetric wall to such a depth that a pool of metal in the reservoir will be maintained at a level adjacent the top of the perimetric wall and metal produced in excess of that amount will drain through said one or more notches.

2. A cell for producing metal by electrolytic reduction of a metal halide in a molten salt bath comprising the metal halide dissolved in at least one molten salt of higher electrode-composition potential than the metal halide, said cell comprising:

(a) a plurality of electrodes, disposed horizontally and arranged in at least one vertical stack;

(b) each stack including a cathode, at least one intermediate bipolar electrode and an anode;

(c) the electrodes in each stack being adapted to be located beneath the upper level of the bath and arranged in a superimposed, spaced relationship defining inter-electrode spaces between each pair of adjacent electrodes;

(d) the upper face of each cathode and of each of the bipolar electrodes having at least one reservoir, bounded by a perimetric wall, for collecting metal produced during operation of the cell; and (e) level maintaining means within said reservoir to maintain a pool of metal at a predetermined level adjacent the top of said perimetric wall whereby the cathode face of each electrode is protected by a layer of metal and the flow of excess metal from said reservoir is directable toward predetermined paths of metal flow within said cell and away from gas flow paths, said level maintaining means comprising one or more tubes having at least end within the reservoir slightly below the top of said perimetric wall and a lower end adjacent the sidewall of said electrode.

3. The cell of claim 1 or 2 wherein a vertical bath supply passage is provided adjacent the stack of electrodes and a vertical gas-lift passage spaced from said bath supply passage is also provided and said level maintaining flow of metal toward said bath supply passage.

4. The cell of claim 3 wherein at least one inclined gas channel is provided in the lower face of each electrode for conducting gas producing during operation of the cell from the inter-electrode spaces to said gas-lift passage, said inclined gas channel being inclined upwardly in a direction toward said gas-lift passage to assist in directing the flow of gas toward said gas-lift passage whereby the flow of gas and the flow of metal are kept separate to minimize recombining of the gas and metal.

5. The cell of claim 4, which includes two stacks of electrodes, having associated therewith a common bath-supply passage.

6. The cell of claim 4, including a baffle, located adjacent to the gas-lift passage of each stack, which extends vertically above the uppermost electrode of the stack and which is adapted to assist in directing the flow of the bath from the gas-lift passage across the top of the stack but beneath the upper level of the bath.

7. The cell of claim 4, wherein the metal is lead and the bath comprises a mixture of lead chloride, potassium chloride and lithium chloride.

8. The cell of claim 7, wherein the metal-collecting zone below each stack has a first chamber which is in fluid communication with the bath-supply passage of the stack, a second chamber spaced apart from the first chamber, a lateral passage which provides fluid communication between and at the bottom of the chambers, and a tapping port, for removal of metal, in the second chamber located above the level of the lateral passage, the metal-collecting zone being adapted so that metal collected in the bottom of the first chamber may flow into the second chamber to fill the second chamber to a height sufficient to prevent the entry of bath into the second chamber.

9. The cell of claim 7, wherein the weight ratio of potassium chloride to lithium chloride in the bath is within the range of 1:1.4 to 2:1.

10. The cell of claim 9, wherein the bath comprises a mixture of 20–70% by weight lead chloride, 15–55% by weight potassium chloride and 10–40% by weight lithium chloride.

11. The cell of claim 9, wherein the bath comprises a mixture containing about 40% by weight lead chloride, 35% by weight potassium chloride and 25% by weight lithium chloride.

* * * * *